United States Patent [19]

Schickel et al.

[11] 4,378,237

[45] Mar. 29, 1983

[54] DEVICE FOR THE MANUFACTURE OF A FLEECE OF INORGANIC AND ORGANIC FIBROUS MATERIAL

[75] Inventors: Alfred Schickel, Freiberg; Klaus-Dieter Rochlitz, Querfurt; Thea Müller, Dessau, all of German Democratic Rep.

[73] Assignee: VEB Zement Kombinat, Dessau, German Democratic Rep.

[21] Appl. No.: 239,879

[22] Filed: Mar. 2, 1981

[51] Int. Cl.[3] ..... C03B 37/00

[52] U.S. Cl. ..... 65/9; 65/4.4; 156/62.4

[58] Field of Search ..... 65/4.4, 9; 156/62.4

[56] References Cited

U.S. PATENT DOCUMENTS 3,446,610 5/1969 Riedel ..... 65/9

3,773,485 11/1973 Corsentino ..... 65/9

3,787,194 1/1974 Rayle et al. ..... 65/9

FOREIGN PATENT DOCUMENTS 902817 8/1962 United Kingdom ..... 65/9

902818 8/1962 United Kingdom ..... 65/9

*Primary Examiner*—Robert L. Lindsay, Jr.

*Attorney, Agent, or Firm*—Jordan and Hamburg

[57] ABSTRACT

The present invention is directed to an apparatus for manufacture of a fleece with irregularly erect fiber structure which comprises a chamber attached to a spinning chamber, the first chamber comprising at least one high voltage electrode and a grounded electrode forming a channel, the electrodes forming an electrostatic field for aligning fibers with the grounded electrode serving as an air-permeable base for forming the fleece.

8 Claims, 1 Drawing Figure

DEVICE FOR THE MANUFACTURE OF A FLEECE OF INORGANIC AND ORGANIC FIBROUS MATERIAL

BACKGROUND

The subject of the invention is a device for the preparation of a fleece from inorganic and organic fibrous materials, such as mineral wool and glass wool, wherein the fibers of the web are irregularly erected relative to its plane of extension, and which serves as starting material for the production of fibrous products having resistance to pressure and high stability of shape, such as fibrous blankets, mats and plates.

Devices for the preparation of a fleece of inorganic or organic fibrous materials wherein the fibers are irregularly erect in relation to its plane of extension were previously unknown.

It is generally known that the fibers or fiber aggregates (henceforth called fibers) are led by an airstream produced by a blower, after their creation into a chamber where the fibers are deposited upon conveyor means and become a fleece. Fibers carried along by the airstream are sucked into the nascent fleece. That forces the fibers to adopt a position corresponding to the plane of the fleece.

It is a disadvantage of this process that the fleece does not become sufficiently voluminous, so that large amounts of material are needed for the creation of a fleece. Furthermore, the orientation of the fibers within the fleece does not allow for the production of fibrous materials with great resistance to pressure and with great stability of shape. That is countered by an expensive subsequent treatment of the fleece. Subsequent treatment is done, for instance, by stabilizing and hardening a web with binders, cutting it in parallel strips, turning the strips by 90° and glueing the strips close together upon a supporting material (Information 105-Anwendungstechnische Mitteilungen der Deutschen Rockwool-GmbH, Gladbeck BRD).

For that, a large amount of material and technical appliances is needed as well as high costs of manufacture and upkeep, all facts which increase the costs of fiber products. Furthermore, a device for the manufacture of plush-like goods was disclosed. (DE-OS No. 2809019). It consists of a fiber distributor underneath of which was arranged in series: a grounded electrode formed as a classifying grid, a high voltage electrode developed as a charge grid, and close to the base another grounded electrode. The fibers, fed in by the conveyor, reach the electrostatic field through the classification grid, are aligned therein, and are brought upon the base after traversing the charge grid and the second grounded electrode. This device is not suited for the preparation of a fleece with irregularly erected fibers. The reason is that the very irregular fibers which are often balled together into larger aggregates plug up the passage apertures of the classification and charge grids instead of passing through, a fact which is apt to constantly interrupt the feeding of the fleece with fibers. Constant disturbances of production are the consequence, and the output of such devices is greatly diminished.

The object of the invention is to develop a device for the preparation of a fleece which makes it possible to minimize the amount of material for a fleece, to assure a continuous course of production and to considerably avoid subsequent treatment of the fleece for an increase of resistance to pressure and high stability against deformation.

SUMMARY

The cause of the technical disadvantages is specifically, that the fibers are carried by the airstream into the chamber in a direction vertical to their largest plane of attack and that they are deposited onto the fleece in its plane, thereby causing the horizontal fiber structure of the fleece and also its relative density. Therefore it is the objective of the invention to develop a device allowing for creation of the preconditions for obtaining high pressure resistance and shape stability of fibrous products initially when preparing the fleece by a corresponding orientation of the fibers. The invention fulfills this object by disposing a channel in a chamber and bringing this channel from a spinning machine, where at least one of the limiting planes of said channel is formed by at least one electrically insulated high tension electrode and where another opposite limiting plane is formed by a grounded electrode and where the limiting plane, formed by the grounded electrode, is developed and disposed in such a manner, that it forms an air-permeable base for the nascent fleece.

The limiting plane formed by the grounded electrode preferably contains a metallic air-permeable conveyor material, which by itself is well known.

The high potential electrode is connected to a pole carrying the high potential U and the grounded electrode is connected to the grounded pole of the asymmetrical d.c. potential outlet of a controllable high voltage source. The chamber consists completely of non-conductive material.

When the source of high voltage is switched on, an electrostatic field of at least 50 kV/m arises between the electrodes of the channel. The fibers, created by the spinning machine and brought by an airstream into the channel, are turned by the electrostatic field into the direction of the field vertical to the fleece. In that position the fibers reach the lower limiting plane of the channel, which is developed as a grounded electrode, by aid of the airstream turned by 90° in the channel. The fibers form upon this base a fleece with a structure of irregularly erect fibers.

Furthermore, the invention is explained by detailed description of a preferred embodiment and by a drawing too.

DETAILED DESCRIPTION OF THE PREFERRED EMBODIMENT

Figure 1:
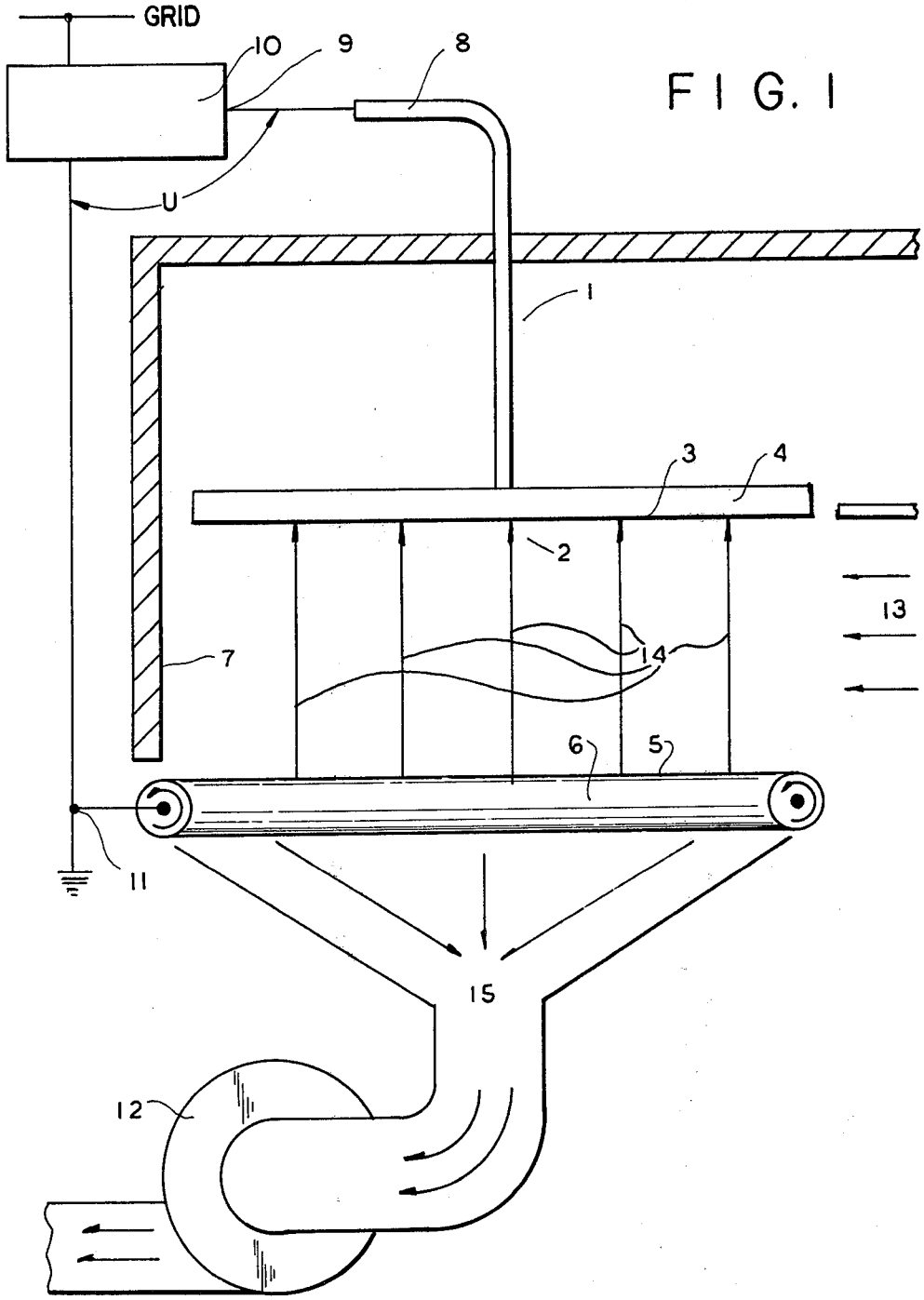
FIG. 1 is a sectional view of the device of the present invention.

The device contains chamber 1, furnished with a channel 2, connected on one side with the spinning chamber (not shown). The upper limiting plane 3 of channel 2 is formed by an electrically insulated high voltage electrode 4. The lower limiting plane 5 of channel 2 consists of an air permeable, bare and electrically grounded electrode 6 which serves simultaneously as the base for the fleece. In this example, the grounded electrode 6 consists of a metallic wire-mesh belt. Channel 2 is closed at one side by the frontal partition 7 of chamber 1.

The high tension electrode 4 is connected by cable 8 to one pole 9 of the source of high potential 10. The grounded electrode 6 is connected to the grounded pole 11 of the asymmetrical d.c. outlet of the source of high potential 10. An inspiration means 12 for sucking air out of chamber 1 is disposed underneath the air-permeable grounded electrode 6.

Chamber 1 is completely constructed of non-conducting masonry. A grounded potential electrode is built into the floor all around the chamber in order to protect the working personnel. The area of the built-in electrode is surrounded by means against unauthorized crossing (not shown). It is advantageous to erect the chamber at a sufficient distance from electrically-conducting conductors. Switching on of high potential source 10 creates an electrostatic field 14 of high strength in channel 2 by means of the high voltage electrode 4 and the grounded electrode 6. Fibers prepared in the spinning chamber and free of any binders are carried by the airstream 13 into channel 2 and thereby into the region of the electrostatic field. Here, the fibers are turned into the direction of the field by the use of the moment of rotation created by the electrostatic field and thereby into an irregularly erect position 14 relative to the extension of the fleece. The airstream 13 is inspired across the air-permeable electrode 6 by suction means 12. Thereby the turned fibers are brought onto electrode 6 in this position and form a fleece of irregularly erect fiber structure. 15 indicates the inspired airstream.

This device is suitable for the production of a fleece with irregularly erect fiber structure which can be used as a starting material for the production of fibrous webs, fibrous mats and fibrous plates, having high resistance against compression and great stability of shape and which allows economical use of the filament material.

The device according to the invention allows obtention for the first time of the desired irregularly erect fiber orientation for the preparation of a fleece and thereby removes a whole series of consecutive, expensive, working steps for changing the thread structure in filamentous products. That allows for keeping of costs of working and upkeep low and thereby lowers the costs of producing filamentous products.

We claim:

1. An apparatus for preparing a fiber agglomerate with an irregularly erect fiber structure comprising, (A) an air stream channel carrying fibers to be oriented, (B) a chamber disposed at the end of said air stream channel, said chamber comprising (1) at least one electrically-insulated, high voltage electrode, (2) an air-permeable grounded electrode situated underneath said high voltage electrode, (3) a channel within said chamber, in which one limiting plane of said channel is formed by said electrically-insulated high voltage electrode, an opposite limiting plane of said channel is formed by said air permeable grounded electrode, and said air stream is turned substantially perpendicularly in said channel, (4) means for generating an electrostatic field flowing across said channel from said high voltage electrode to said grounded electrode, said electrostatic field creating a moment of rotation orienting said fibers into an agglomerate of substantially erect fiber structure, (5) at least one other edge of said chamber constructed of electrically-nonconductive material, and (C) means for inspiring said air stream through said air-permeable, grounded electrode.

2. The apparatus of claim 1 in which said high voltage electrode is connected to a pole carrying high potential electrical current and said grounded electrode is connected to a grounded pole of an asymmetrical direct potential outlet of a controllable high voltage source.

3. The apparatus of claim 2 in which said electrostatic field is at least about 50 k V/m between said high voltage and grounded electrodes.

4. The apparatus of claim 3 in which said grounded electrode is a metallic conveyor means.

5. The apparatus of claim 4 in which said metallic conveyor means is a wire-mesh belt.

6. The apparatus of claim 5 in which said chamber is completely constructed of an electrically nonconductive material.

7. A method for preparation of a fiber agglomerate with irregularly erect fiber structure, comprising the steps of (A) introducing individual fibers into an air stream, (B) creating an electrostatic field from an electrically insulated, high voltage electrode above said air stream to an air-permeable, grounded electrode below said air stream, (C) forming a channel with one limiting plane of said channel being formed by said electrically-insulated, high voltage electrode, an opposite limiting plane of said channel being formed by said air-permeable, grounded electrode, and said air stream being turned substantially perpendicularly in said channel, (D) orienting said fibers into an agglomerate of substantially erect fiber structure by means of a moment of rotation generated by said electrostatic field and (E) drawing said fiber agglomerate onto said grounded electrode by suctioning said air stream through said air-permeable, grounded electrode.

8. The method of claim 7 in which said electrostatic field is at least about 50 kV/m between said two electrodes.

* * * * *